US008099832B1

(12) United States Patent
Shuker

(10) Patent No.: US 8,099,832 B1
(45) Date of Patent: Jan. 24, 2012

(54) HINGE ASSEMBLY

(75) Inventor: John Shuker, Wolverhampton (GB)

(73) Assignee: Multimatic Advanced Technologies Inc. (BB)

( * ) Notice: Subject to any disclaimer, the term of this patent is extended or adjusted under 35 U.S.C. 154(b) by 0 days.

(21) Appl. No.: 09/622,674

(22) PCT Filed: Feb. 19, 1999

(86) PCT No.: PCT/GB99/00522

§ 371 (c)(1),
(2), (4) Date: Oct. 2, 2000

(87) PCT Pub. No.: WO99/42689

PCT Pub. Date: Aug. 26, 1999

(30) Foreign Application Priority Data

Feb. 20, 1998 (GB) ..... 9803486.1

(51) Int. Cl.
*E05D 5/06* (2006.01)

(52) U.S. Cl. ..... 16/319; 16/54; 16/375

(58) Field of Classification Search ..... 16/319, 16/321, 334, 343, 344, 54, 375; 403/113, 403/114

See application file for complete search history.

(56) References Cited

U.S. PATENT DOCUMENTS

| | | | | |
|---|---|---|---|---|
| 1,207,270 | A * | 12/1916 | Braithwaite | 16/329 |
| 2,501,581 | A * | 3/1950 | Rieger | 16/349 |
| 3,390,420 | A * | 7/1968 | Foltz | 16/276 |
| 3,583,734 | A * | 6/1971 | Magi | 403/96 |
| 5,412,842 | A * | 5/1995 | Riblett | 16/334 |
| 5,713,633 | A * | 2/1998 | Lu | 297/364 |
| 6,092,334 | A * | 7/2000 | Kim | 49/8 |
| 7,681,283 | B2 * | 3/2010 | Koshikawa et al. | 16/303 |
| 2007/0050940 | A1 * | 3/2007 | Lowen et al. | 16/334 |

FOREIGN PATENT DOCUMENTS

| | | | |
|---|---|---|---|
| DE | 3137134 | A | 7/1982 |
| DE | 29614386 | | 10/1996 |
| EP | 443919 | A1 * | 8/1991 |
| FR | 2670530 | | 6/1992 |
| FR | 2705389 | A | 11/1994 |

OTHER PUBLICATIONS

PCT/GB99/00522—International Preliminary Examination Report, May 19, 2000.
PCT/GB99/00522—International Search Report, May 21, 1999.

* cited by examiner

*Primary Examiner* — Victor Batson
*Assistant Examiner* — Matthew Sullivan
(74) *Attorney, Agent, or Firm* — Kilpatrick Townsend & Stockton LLP

(57) ABSTRACT

A hinge assembly including a first hinge leaf hingedly connected to a second hinge leaf by a hinge pin (14), the hinge pin (14) being rotatably mounted in one hinge leaf (12) non-rotatably mounted in the other hinge leaf (11), and a check mechanism (30) operably connected to the hinge pin (14) and said one hinge leaf (12) to releasably hold the first and second hinge leaves (11, 12) at at least one angular position about the hinge axis, the check mechanism (30) including check means (32) resiliently biased in a radial direction relative to the hinge axis and into contact with an annular cam track (34) formed on a reaction member (33), the check means (32) being driven along said annular cam (34) by relative rotation between said first an second hinge leafs (11, 12), the cam track (34) including at desired locations therealong one or more check formations (38) which cooperate with said check means (32) to releasably retain the first and second hinge leafs (11, 12) at a desired angular position relative to one another.

7 Claims, 2 Drawing Sheets

HINGE ASSEMBLY

The present invention relates to a hinge assembly incorporating a check mechanism. The hinge assembly is particularly, but not exclusively, suitable for use as a vehicle door hinge.

A vehicle is normally provided with a door check mechanism which operates on the door to releasably hold the door in an open position. This is desirable to resist premature closing of a door when a person is entering or leaving a vehicle.

It is known to provide door check mechanisms which are separate from the door hinge assemblies which hingedly connect the door to the vehicle body. Although this type of door check mechanism works well, they are undesirable as they require separate assembly when mounting the door onto the vehicle body.

Door hinges are known which incorporate door check mechanisms. Such door hinges tends to be bulky in size and cannot therefore be fitted to vehicles where there are space constraints.

A general aim of the present invention is to provide a hinge assembly incorporating a door check mechanism which is compact in size.

According to one aspect of the present invention there is provided a hinge assembly including a first hinge leaf hingedly connected to a second hinge leaf by a hinge pin, the hinge pin being rotatably mounted in one hinge leaf and non-rotatably mounted in the other hinge leaf, and a check mechanism operably connected to the hinge pin and said one hinge leaf to releasably hold the first and second hinge leaves at least one angular position about the hinge axis, the check mechanism including check means resiliently biased in a radial direction relative to the hinge axis and into contact with an annular cam track formed on a reaction member, the check means being driven along said annular cam track by relative rotation between said first and second hinge leafs, the cam track including at desired locations therealong one or more check formations which co-operate with said check means to releasably retain the first and second hinge leafs at a desired angular position relative to one another.

Preferably the check means includes a check body rotatably located within said annular track, the check body including two or more check members which are spaced from one another circumferentially about the hinge axis, the check members being biased in a radial outward direction to engage and run along said cam track.

Preferably the check formations are in the form of recesses spaced along the cam track into which the check members are received in order to releasably retain the hinge leafs at a desired angular position relative to one another.

Advantageously, the check members are in the form of balls.

Various aspects of the present invention are hereinafter described with reference to the accompanying drawings, in which:—

Figure 1:
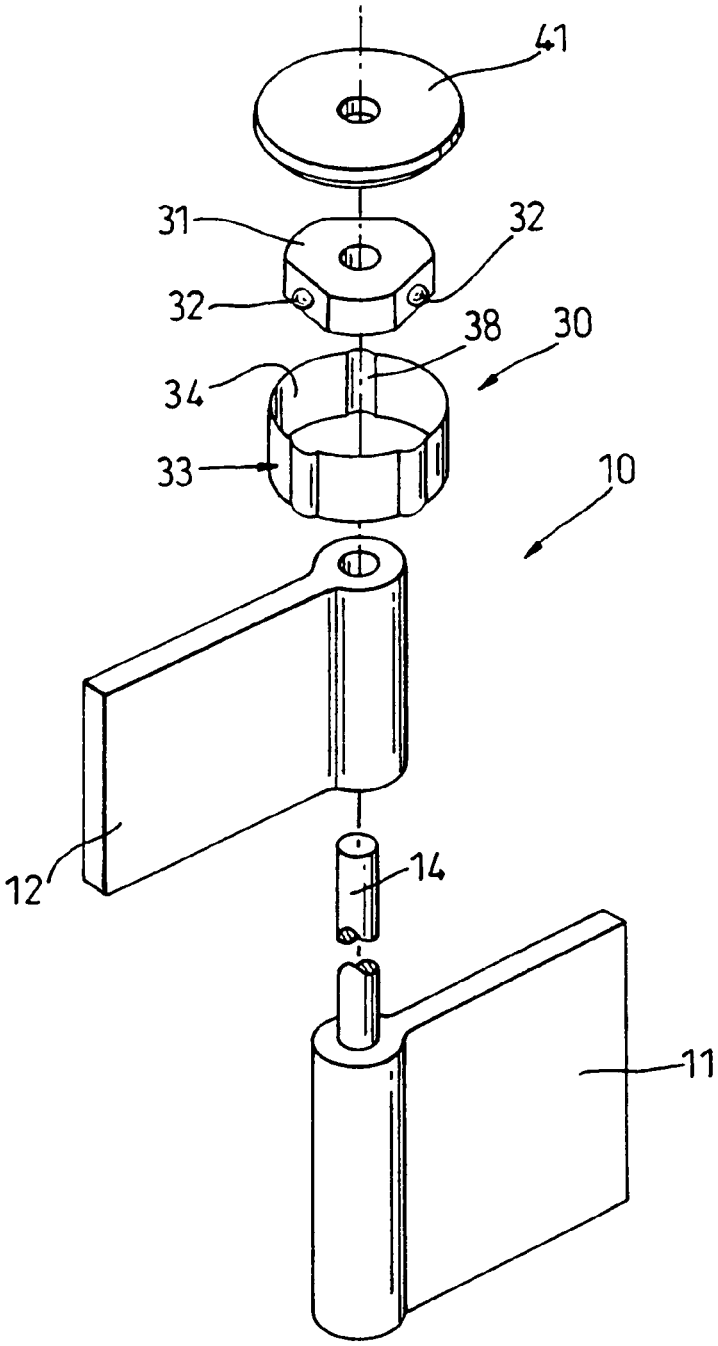
FIG. 1 is an exploded schematic view of a hinge assembly according to one embodiment of the present invention.

There is shown in the drawings a hinge assembly 10 including a first hinge leaf 11 which is pivotally connected to a second hinge leaf 12 by a hinge pin 14.

The hinge pin 14 is fixedly secured to hinge leaf 11 so as not to be rotatable relative thereto. Typically the hinge pin 14 is made of a suitable hard wearing steel and hinge leaf 11 may be formed from a metal pressing or forged or cast metal.

The hinge pin 14 projects axially from hinge leaf 11 to be rotatably received within hinge leaf 12. Preferably bushes (not shown) may be provided for rotatably supporting the hinge pin within the hinge leaf 12.

Figure 2:
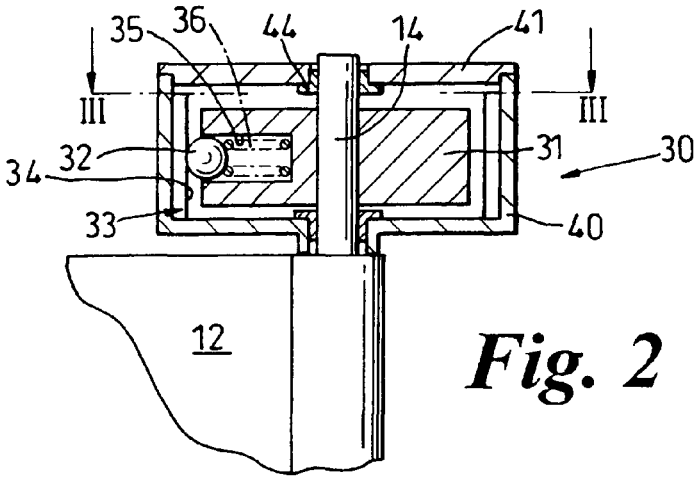
FIG. 2 is an axial section through part of the hinge assembly of FIG. 1.
Figure 3:
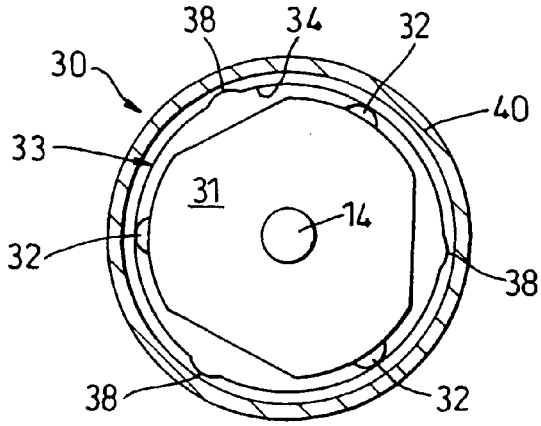
FIG. 3 is a sectional view taken along line in FIG. 2.

As more clearly seen in FIG. 2, the hinge pin 14 projects axially beyond hinge leaf 12 to be received within a check mechanism 30.

The check mechanism 30 includes a check body 31 containing check members 32 which are biased radially outwardly into contact with a surrounding check reaction member 33.

The check body 31 is fixedly secured to the hinge pin 14 so as to be non-rotatable relative thereto and the check reaction member 33 is fixedly secured to the hinge leaf 12 so as to be non-rotatable relative thereto. Accordingly rotation of hinge leafs 11, 12 relative to one another causes check body 31 to rotate relative to check reaction member 33.

The check reaction member 33 has inner annular face 34 which defines a cam track about which check members 32 run on rotation of the check body 31 relative to the check reaction member 33.

Preferably the check members 32 are in the form of balls, preferably made from a hard wearing material such as steel.

Each check member 32 is located in a radially extending bore 35 formed in the body 31 and is biased into contact with the cam track by resilient means preferably in the form of a resilient spring 36. Other forms of resilient means may be used if desired, for example a block of resiliently deformable material may be used.

The angular spacing of bores 35 about the axis of rotation of the hinge pin 14 is preferably chosen such that radially inwardly directed loadings applied by the check members 32 is balanced and equally distributed about the axis of rotation.

The number of check members 32 in the illustrated embodiment is three; however, it will be appreciated that more or less than three check members 32 may be provided: it being preferable to have at least two in order to enable radially inwardly directed loadings to be balanced.

In order to provide checked angular positions at which the hinge leafs 11, 12 are releasably held at desired relative angular positions, check recesses 38 are provided within the cam track.

The recesses 38 are preferably arranged in a group in which the recesses of the group correspond in number and spacing to the check members 32 so that at a desired checked angular position all check members 32 enter a corresponding recess 38 of the group. Accordingly all check members 32 simultaneously act to resist rotation of the hinge leafs from the checked position and so thereby enable a high check force to be generated.

It will be appreciated that more than one checked angular position may be provided by providing additional groups of recesses 38 which are spaced from one another along the cam track.

Preferably the check reaction member 33 is in the form of an annulus which is preferably formed from a sintered metal.

The reaction member 33 is preferably non-rotatably mounted within a housing 40 which is fixedly secured to the hinge leaf 12. The housing 40 is preferably a metal pressing.

Preferably the housing 40 has an open top which is closed by an end cap 41. Preferably the end cap 41 is also a metal pressing and is preferably fixedly secured to the housing 40 after assembly of the check mechanism.

The end cap 41 is preferably provided with a central opening housing a bush 44 in which the hinge pin 14 is rotatably mounted. With such an arrangement, the hinge pin 14 is positively rotatably mounted at two axial positions located on opposite axial sides of the check body 31.

Figure 4:
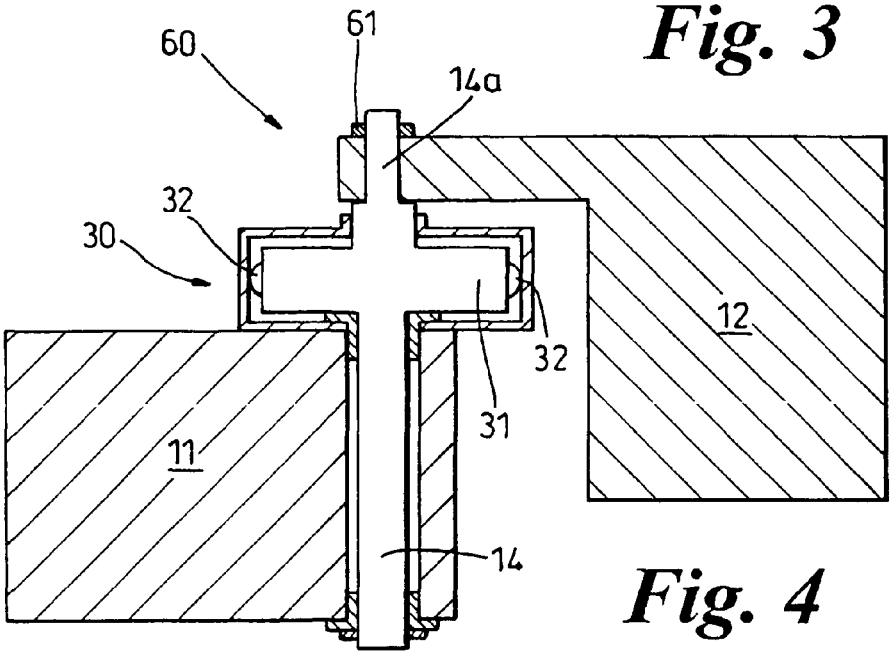
FIG. 4 is an axial section similar to FIG. 2 showing another embodiment according to the present invention.

A second embodiment 60 is illustrated in FIG. 4 wherein parts similar to those found in the first embodiment 10 are designated by the same reference numerals.

The hinge assembly of the second embodiment is adapted so as to provide a hinge assembly having a lift-off facility.

In this respect, hinge pin 14 is arranged to pass directly into the check mechanism 30 from hinge leaf 11. The hinge pin 14 is provided with an extension portion 14*a* which projects axially beyond the check mechanism 30 to be axially received in hinge leaf 12. The pin portion 14*a* is preferably axially slidably received within hinge leaf 12 but is non-rotatable therein. Accordingly relative rotation between hinges 11 and 12 causes the hinge pin 14 to rotate within hinge leaf 11.

Since hinge pin 14 is axially slidably received in the hinge leaf 12, it is possible to separate hinge leaves 11, 12 by axial displacement therebetween.

In normal use, such axial separation of the hinge leaves 11, 12 is prevented, for example by removable retention means 61 such as a clip or threaded nut on the pin portion 14*a*, or by weight of the door which is hingedly supported by the hinge assembly 60.

The invention claimed is:

1. A hinge assembly including a first hinge leaf hingedly connected to a second hinge leaf by a hinge pin, the hinge pin being rotatably mounted in one hinge leaf and non-rotatably mounted in the other hinge leaf, and a check mechanism operably connected to the hinge pin and said one hinge leaf to releasably hold the first and second hinge leaves at least one angular position about the hinge axis, the check mechanism including a check body which is fixed to the hinge pin and is rotatably located within an annular cam track, the check body including two or more check members which are equally spaced from one another circumferentially about the hinge axis, the check members being resiliently biased in a radial outward direction relative to the hinge axis to engage and run along said cam track, the check body being driven along said annular cam track by relative rotation between said first and second hinge leafs, the cam track including at desired locations therealong one or more check formations which co-operate with said check means to releasably retain the first and second hinge leafs at a desired angular position relative to one another, the cam track being formed on a reaction member which is non-rotatably located in a housing fixedly secured to said one hinge leaf, the reaction member being in the form of an annulus.

2. A hinge assembly according to claim 1 wherein the housing has a bottom wall and an open top closed by an end cap, the check body being located in between the bottom wall and end cap and the hinge pin being rotatably supported in said bottom wall and end cap.

3. A hinge assembly according to claim 1 wherein the check formations are in the form of recesses spaced along the cam track into which the check members are received in order to releasably retain the hinge leafs at a desired angular position relative to one another.

4. A hinge assembly according to claim 3 wherein the recesses are arranged in one or more groups corresponding to respective check positions, the recesses in each group corresponding in number and circumferential spacing to the number and circumferential spacing of the check members such that at a desired check position all check members are located in a corresponding recess of the group.

5. A hinge assembly according to claim 1 wherein the check members are in the form of balls.

6. A hinge assembly according to claim 5 wherein each ball is located in a radially extending bore formed in the check body in which is housed resilient means for biasing the ball radially outwardly.

7. A hinge assembly according to claim 1 wherein said other hinge leaf is axially withdrawable from the hinge pin so as to define a lift-off hinge assembly.

* * * * *